US009637845B2

(12) United States Patent
Morales

(10) Patent No.: US 9,637,845 B2
(45) Date of Patent: May 2, 2017

(54) RIP-STOP FABRIC WITH MECHANICAL STRETCH FIBERS

(75) Inventor: Francisco J. Morales, Modesto, CA (US)

(73) Assignee: 5.11, INC., Irvine, CA (US)

( * ) Notice: Subject to any disclaimer, the term of this patent is extended or adjusted under 35 U.S.C. 154(b) by 389 days.

(21) Appl. No.: 13/602,745

(22) Filed: Sep. 4, 2012

(65) Prior Publication Data

US 2013/0237110 A1 Sep. 12, 2013

Related U.S. Application Data

(60) Provisional application No. 61/530,342, filed on Sep. 1, 2011.

(51) Int. Cl.

| | |
|---|---|
| ***D03D 13/00*** | (2006.01) |
| ***D03D 15/00*** | (2006.01) |
| ***D03D 1/00*** | (2006.01) |
| ***D03D 15/08*** | (2006.01) |
| ***D06B 1/00*** | (2006.01) |

(52) U.S. Cl.

CPC ..... *D03D 1/00* (2013.01); *D03D 13/004* (2013.01); *D03D 15/0027* (2013.01); *D03D 15/08* (2013.01); *D06B 1/00* (2013.01); *D10B 2201/02* (2013.01); *D10B 2201/20* (2013.01); *D10B 2331/04* (2013.01); *D10B 2501/04* (2013.01); *D10B 2507/00* (2013.01); *Y10T 442/3065* (2015.04)

(58) Field of Classification Search

CPC ..... D03D 13/00; D03D 13/004; D03D 15/00; D06M 2200/01; D06M 2200/11; D10B 2331/04

USPC ... 442/91–95, 199, 203, 208, 209, 216, 218; 139/420 R, 421

See application file for complete search history.

(56) References Cited

U.S. PATENT DOCUMENTS

| | | | | |
|---|---|---|---|---|
| 2003/0092339 | A1* | 5/2003 | Covelli | 442/208 |
| 2003/0203690 | A1 | 10/2003 | Hess et al. | |
| 2003/0228812 | A1 | 12/2003 | Stanhope et al. | |
| 2005/0109418 | A1* | 5/2005 | Liao | D03D 15/08 139/420 R |
| 2006/0084337 | A1 | 4/2006 | Corner et al. | |
| 2006/0128243 | A1* | 6/2006 | Kong et al. | 442/182 |
| 2006/0228964 | A1* | 10/2006 | Watkins et al. | 442/94 |
| 2007/0135009 | A1* | 6/2007 | Liao | 442/209 |
| 2009/0193584 | A1* | 8/2009 | Stewart | A47G 9/0246 5/495 |
| 2009/0233507 | A1* | 9/2009 | Gross et al. | 442/82 |

(Continued)

FOREIGN PATENT DOCUMENTS

| | | |
|---|---|---|
| CN | 1585842 | 2/2005 |
| JP | 07-082629 A | 3/1995 |
| JP | 2000-008247 A | 1/2000 |

(Continued)

OTHER PUBLICATIONS

JP 2002-004145. Jan. 2002 English Translation and Abstract.*

(Continued)

*Primary Examiner* — Jenna Johnson

(74) *Attorney, Agent, or Firm* — Kilpatrick Townsend & Stockton LLP

(57) ABSTRACT

A ripstop fabric having multi-component polyester filament yarns interwoven into spun yarns in a ripstop pattern.

20 Claims, 1 Drawing Sheet

(56) References Cited

U.S. PATENT DOCUMENTS

2011/0091412 A1* 4/2011 Wittrup ..... C07K 14/55
424/85.2

FOREIGN PATENT DOCUMENTS

| | | | | |
|---|---|---|---|---|
| JP | 2002-004145 | A | | 1/2002 |
| JP | 2002004145 | A | * | 1/2002 |
| WO | 03042438 | | | 5/2003 |
| WO | 2006088538 | | | 8/2006 |

OTHER PUBLICATIONS

International Search Report and Written Opinion mailed Nov. 7, 2012 in Application No. PCT/US2012/053696 filed Sep. 4, 2012.
Chinese Patent Application No. 201280042588.6, Notice on the First Office Action, mailed Oct. 8, 2014, with English translation.
CN201280042588.6, "Office action," mailed Jul. 1, 2015, 27 pages.
Congyang, Chen and Liu Jinhui, "Discussion on Dyeing and Finishing of T-400 Polyurethane Interwoven Fabric," *Dyeing and Finishing Technology*, vol. 28, No. 6 (Jun. 2006), pp. 20-22.
Xiaojin, Mei, "Dyeing and Finishing of Bamboo Fiber Polyurethane/T-400 Dual Elastic Fabrics," *Printing and Dyeing*, No. 24 (Nov. 2007), pp. 13-15.
Yan, Li and Feng Jincheng, "Development of Functional T-400 Yarn-Dyed Fabric and Comparison of Wearability," *Scientific Research and Practice*, No. 1, Article No. 1672 (Mar. 2006), pp. 1-3.
CN201280042588.6 , "Office Action", Jan. 21, 2016, 22 pages.
CN201280042588.6 , "Office Action", Oct. 9, 2016, 17 pages.

* cited by examiner

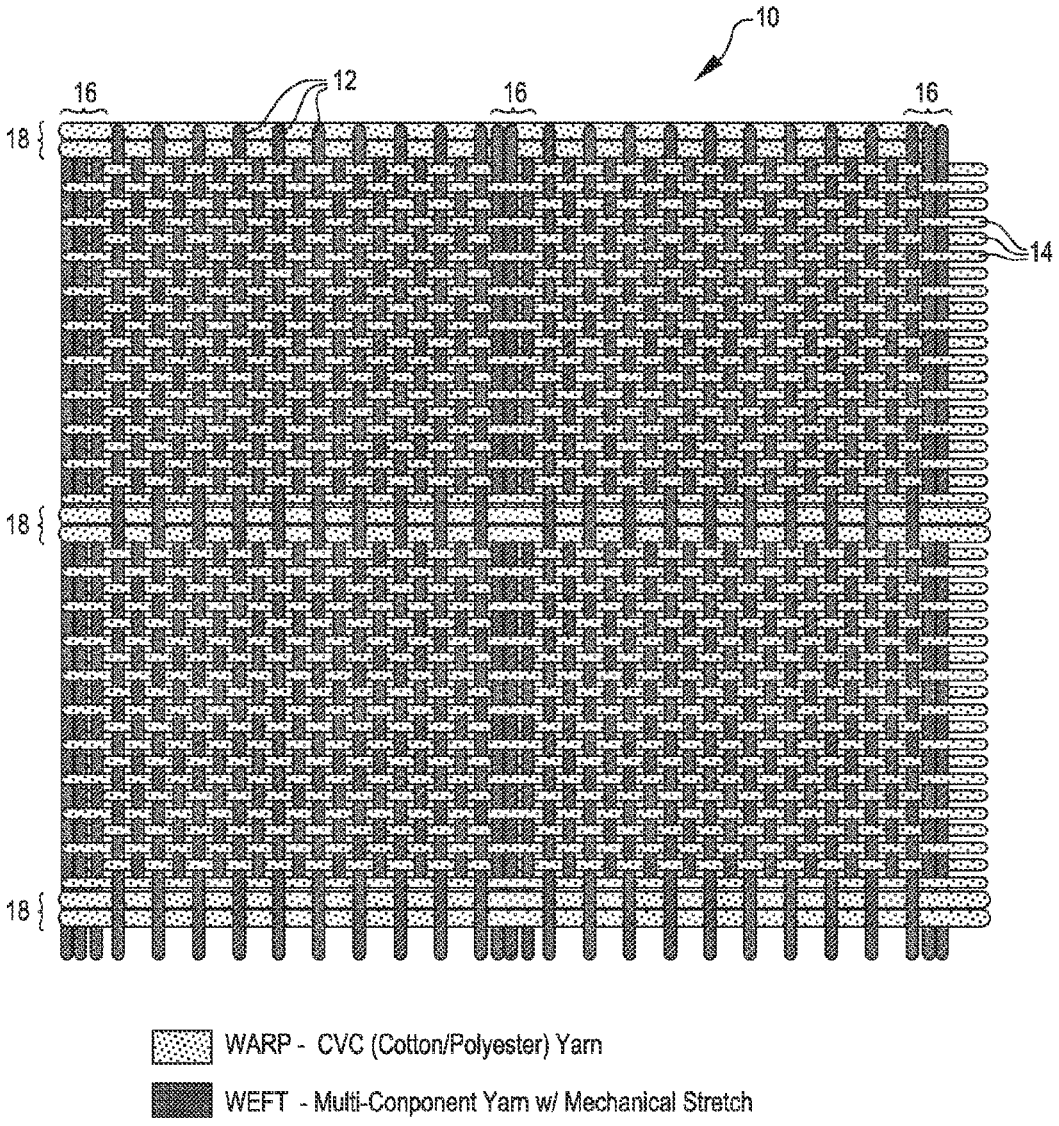
10
12
16
16
16
18
18
18
14
WARP - CVC (Cotton/Polyester) Yarn
WEFT - Multi-Conponent Yarn w/ Mechanical Stretch

RIP-STOP FABRIC WITH MECHANICAL STRETCH FIBERS

CROSS-REFERENCES TO RELATED APPLICATIONS

The present application claims the benefit of U.S. Provisional Application No. 61/530,342, filed on Sep. 1, 2011, the full disclosure of which is incorporated herein by reference.

BACKGROUND

Rip-stop woven fabrics are commonly used for military and police uniforms and most rip-stop fabrics used for police and military uniforms are made in blends of polyester/cotton, cotton/polyester, and nylon/cotton. The strength, ease of care, and fade-resistance properties of rip-stop fabrics for police and military uniforms have been enhanced by this blending of polyester or nylon with cotton. Stain and water resistant finishes can be applied to the fabrics to further improve durability and ease of care.

A key requirement for rip-stop fabrics used for police and military uniforms is for them to be able to withstand 50+ washes and extensive field used while still delivering comfort to the wearer. Therefore, durability and comfort become the two most important attributes of these fabrics.

A very popular way to add comfort to a fabric is by adding stretch. Commonly, stretch has been added to fabrics by using elastic fibers, such as spandex or elastane fibers. Spandex fibers present technical challenges when used in fabrics with a polyester content higher than 40%, because spandex fiber degrades during the dyeing process as the polyester is dyed at higher temperatures than cotton or other cellulosic-based materials. In addition, spandex fibers can further degrade when stain repellant finishes are added to the fabric as they are heat-set during the finishing stage.

Further, the extensive washing cycles that police and military uniforms go through further degrade the spandex in fabric, reducing the usable life of the fabric. As a result, all the rip-stop fabrics made for police and military uniforms today that are made in polyester/cotton or nylon/cotton blends do not offer stretch properties.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Embodiments herein are directed to a rip-stop fabric incorporating mechanical stretch fibers, as opposed to elastic stretch fibers such as spandex.

In embodiments, the rip-stop woven fabric made with at least two type of yarns. The first yarn is spun from an intimate blend of staple/commercially-available fibers, with one of the fibers being cellulose-based (e.g., cotton or rayon) and the other fiber being polyester, nylon, or modacrilic. The second yarn is a filament multi-component polyester yarn or elasterell-p multi-component filament yarn.

For a fuller understanding of the nature and advantages of the present invention, reference should be made to the ensuing detailed description and accompanying drawings.

BRIEF DESCRIPTION OF THE DRAWINGS

FIG. 1 is a representation of a fabric in accordance with embodiments.

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Embodiments herein are directed to a rip-stop fabric that features the combination of mechanical stretch, rip-stop weave, and fade resistance.

The rip-stop woven fabric is made with at least two type of yarns. The first yarn is spun from an intimate blend of staple/commercially-available fibers, with one of the fibers being cellulose-based (e.g., cotton or rayon) and the other fiber being polyester, nylon, or modacrilic (hereinafter "spun fibers" or "spun yarns"). The second yarn is a filament multi-component polyester yarn or elasterell-p multi-component filament yarn (hereinafter "multi-component polyester filament yarns" or "multi-component polyester filament fibers"). Such multi-component polyester filament yarns provide a mechanical stretch property for the rip-stop fabric.

Elasterell, or elasterell-p is a specific subclass of inherently elastic, multi-component polyester filament fibers. The U.S. Federal Trade Commission defines "elasterell-p" as fiber formed by the interaction of two or more chemically distinct polymers (of which none exceeds 85% by weight) which contains ester groups as the dominant functional unit (at least 85% by weight of the total polymer content of the fiber) and which, if stretched at least 100%, durably and rapidly reverts substantially to its unstretched length when the tension is removed. Although elasteral-p is described in embodiments, other multi-component polyester filament yarns may be used.

The multi-component filament yarn adds stretch properties to the rip-stop fabric while being able to withstand high dyeing and finishing temperatures, thereby eliminating the need to use spandex and overcoming the durability limitations of spandex.

In embodiments, a woven rip-stop fabric 10 (FIG. 1) is formed by weaving multi-component polyester filament weft yarns 12 into spun warp yarns 14. As shown in FIG. 1, to provide a rip-stop fabric weave, the multi-component polyester filament yarns 12 are interwoven through spun yarns 14 in a plain weave fashion. However, to provide strength and rip resistance, after predetermined intervals, two or more multi-component polyester filament yarns 12 are woven together (instead of each yarn alternating, as in regular plain weave) in the same pattern through the weft yarns. Such a variation in the pattern is shown generally at the areas 16 in FIG. 1. The pattern of weaving multiple (at least 2) adjacent weft yarns in the same weaving direction through the warp yarns is done in regular intervals. Similarly, the same one or more warp yarns may be skipped by each weft yarn during the weaving process, causing multiple spun warp yarns 12 to extend together, as shown generally at the areas 18 of the fabric 10 in FIG. 1. The pattern of weaving multiple adjacent weft yarns in the same weaving direction and skipping at least one weft yarn consistently during weaving can be done in regular intervals, providing a crosshatch pattern in the weave. The intervals are typically 3 to 8 millimeters, but may be altered to provide a desired function. In embodiments, the interval pattern in the weft direction is the same as the warp direction, so that the crosshatch forms repeating squares.

Alternatively, the multi-component polyester filament yarns 12 may be used as weft material, and the spun fibers 14 may be woven into the multi-component polyester filament yarns, forming a ripstop pattern.

After weaving, a stain and oil repellant finish is added during the finishing process to improve fade resistance and protect the woven fabric from stains. Again, the mechanical stretch properties of the fabric, as contrasted with the more common use of spandex in stretch fabrics, enables the rip-stop fabric of the present disclosure to withstand the high temperatures involved in this finishing process.

The novel ripstop fabric described herein provides a fabric that can last many washes and that is highly suitable for police and military/militia wear, including pants or shirts. The pattern is resistant to wear, is capable of stretching for comfort, and can withstand multiple washes.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A ripstop fabric, comprising a woven fabric consisting of:

a first yarn consisting of a spun yarn comprising an intimate blend of at least one cellulose-based fiber and at least one synthetic fiber comprising at least one of a polyester fiber and a modacrylic fiber; and a second yarn consisting of multi-component polyester filament yarn interwoven with the spun yarn in a ripstop pattern, wherein the first yarn is woven in a first direction and the second yarn is woven in a second direction.

2. The ripstop fabric of claim 1, wherein the spun yarns are weft yarns for the fabric, and the multi-component polyester filament yarns are warp yarns.

3. The ripstop fabric of claim 1, wherein the at least one synthetic fiber is a polyester fiber.

4. The ripstop fabric of claim 1, further comprising a stain and oil repellant finish that is added during a finishing process.

5. Police clothing made with the ripstop fabric of claim 1.

6. Military clothing comprising the ripstop fabric of claim 1.

7. A method of forming a ripstop fabric, comprising a weaving step:

wherein the weaving step consists of weaving a plurality of multi-component polyester filament weft yarns with a plurality of spun warp yarns in a ripstop fabric pattern; and wherein the warp yarns consist of an intimate blend of at least one cellulose-based fiber and at least one synthetic fiber, the at least one synthetic fiber comprising at least one of a polyester fiber and a modacrylic fiber.

8. The method of claim 7, further comprising adding a stain and oil repellant finish during a finishing process.

9. The method of claim 7, further comprising forming the fabric into police clothing.

10. The method of claim 7, further comprising forming the fabric into military clothing.

11. A ripstop fabric, comprising a woven fabric consisting of:

a first yarn consisting of spun yarn, the spun yarn comprising an intimate blend of at least one cellulose-based fiber and at least one synthetic fiber comprising at least one of a polyester fiber and a modacrylic fiber; and a second yarn consisting of one or more uncovered mechanical stretch filaments; wherein the second yarn is interwoven with the spun yarn in a ripstop pattern.

12. The ripstop fabric of claim 11, wherein the fabric comprises warp yarns and weft yarns; and wherein all of the warp yarns are spun yarn and all of the weft yarns are uncovered mechanical stretch filaments.

13. The ripstop fabric of claim 11, wherein the one or more uncovered mechanical stretch filaments comprises a multi-component polyester filament.

14. The ripstop fabric of claim 11, further comprising a stain and oil repellant finish that is added during a finishing process.

15. Police clothing made with the ripstop fabric of claim 11.

16. Military clothing comprising the ripstop fabric of claim 11.

17. A method of forming a ripstop fabric, comprising a weaving step:

wherein the weaving step consists of weaving a plurality of mechanical stretch yarn weft yarns with a plurality of spun yarn warp yarns in a ripstop pattern, wherein the weft yarns consist of one or more uncovered mechanical stretch filaments, and wherein the warp yarns consist of an intimate blend of at least one cellulose-based fiber and at least one synthetic fiber, the at least one synthetic fiber comprising at least one of a polyester fiber and a modacrylic fiber.

18. The method of claim 17, further comprising adding a stain and oil repellant finish during a finishing process.

19. The method of claim 17, further comprising forming the fabric into police clothing.

20. The method of claim 17, further comprising forming the fabric into military clothing.

* * * * *